United States Patent [19]

Larmit

[11] 4,133,353

[45] Jan. 9, 1979

[54] PNEUMATIC WEAVING MACHINE AND WEFT INSERTING DEVICE FOR SUCH A MACHINE

[75] Inventor: Adrianus J. F. Larmit, Moergestel, Netherlands

[73] Assignee: Ruti-Te Strake B. V., Deurne, Netherlands

[21] Appl. No.: 834,706

[22] Filed: Sep. 19, 1977

[30] Foreign Application Priority Data

Sep. 17, 1976 [NL] Netherlands ..... 7610385

[51] Int. Cl.[2] ..... D03D 47/30

[52] U.S. Cl. ..... 139/435

[58] Field of Search ..... 139/435; 226/95, 97

[56] References Cited

U.S. PATENT DOCUMENTS

| | | | |
|---|---|---|---|
| 3,124,167 | 3/1964 | Strake | 139/435 |
| 3,705,608 | 12/1972 | Vermeulen | 139/435 |
| 3,818,952 | 6/1974 | Vermeulen | 139/435 |

*Primary Examiner*—Henry Jaudon

*Attorney, Agent, or Firm*—Marshall & Yeasting

[57] ABSTRACT

A pneumatic weaving machine includes an air fed weft inserting main blowing nozzle cooperating with a device arranged upstream of its inlet and adapted to intermittently interrupt the inserting motion of the weft yarn effected by the nozzle. At least one auxiliary blowing nozzle is arranged in series between the outlet of the main blowing nozzle and the adjacent end of the weaving shed of the machine, there being a free space between the outlet end of the main blowing nozzle and the inlet end of the auxiliary nozzle, through which the air stream from the main blowing nozzle laterally escapes.

4 Claims, 1 Drawing Figure

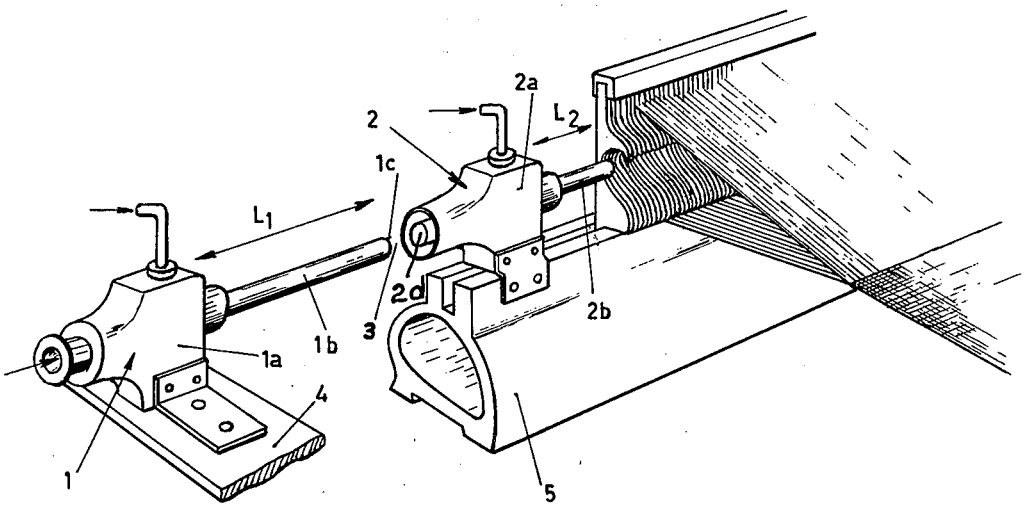
2a
2
L2
1c
L1
2d
3
1b
2b
1a
4
1
5

PNEUMATIC WEAVING MACHINE AND WEFT INSERTING DEVICE FOR SUCH A MACHINE

BACKGROUND OF THE INVENTION

The invention relates to a pneumatic weaving machine of the type in which an air fed weft inserting device constituted by a blowing nozzle cooperates with a device arranged upstream of its inlet and adapted to intermittently interrupt the inserting motion of the weft yarn effected by the nozzle.

Because of increasing production speeds the weft yarn in such weaving machines is more heavily attacked by the forces imposed on it by the air stream of the weft inserting device. With weaker yarn types this might result in that the yarn lengths which, upon completion of a weft inserting phase (—; when the yarn supply to the blowing nozzle is interrupted and the inserted weft thread is cut through at a location between the outlet end of the blowing nozzle and the adjacent end of the weaving shed), remain behind in the blowing nozzle being untwisted to a considerable extent and consequently substantially weakened by the continued air stream or by the remainder of the air stream through the blowing nozzle. This untwisting and weakening might take place to such an extent that the yarn length is severed from the yarn supply and may be finally blown into the weaving shed as a disintegrated mass of fibres, which of course means quite a disturbance of the weaving process. It may also occur that the said yarn length will be broken from the yarn supply only at the start of or during the next weft inserting phase and then be blown through the weaving shed as a separate piece of yarn or mass of fibers by means of the usual auxiliary blowing nozzles located in spaced relationship across the width of the shed. In the most favorable event such yarn length will then be transported by said auxiliary blowing nozzles toward the usual suction device located at the opposite side of the weaving shed, so that the said yarn length will be discharged by said suction device. In both cases, however, the next weft inserting phase will result in a weaving defect, because the yarn piece, which should have formed the leading end portion of the next weft, has disappeared.

SUMMARY OF THE INVENTION

The present invention aims at overcoming said drawbacks. For this purpose according to the invention at least one auxiliary blowing nozzle is arranged in series between the outlet end of the main blowing nozzle of the weft inserting device and the adjacent end of the weaving shed, there being a free space between the outlet end of the main nozzle and the inlet end of the auxiliary nozzle, through which the air stream from the main blowing nozzle laterally escapes.

This means, that the amount of air required for the insertion of the weft yarn into the weaving shed is supplied to the weft inserting device at at least two locations, which are spaced one from the other as seen in the inserting direction. As a consequence, the forces imposed by the air on the weft yarn in the weft inserting device is more evenly distributed along the overall length of the weft inserting device. One could also say that the auxiliary blowing nozzle keeps the yarn length, which remains behind in the weft inserting device, under tension, due to which said yarn length will be able to withstand the untwisting action of the air supplied to the main nozzle. The air which has carried out its weft inserting function in the main blowing nozzle is allowed to escape through the free space between the outlet end of the main blowing nozzle and the inlet end of the auxiliary blowing nozzle. Thus this air need not to be passed through the auxiliary blowing nozzle, due to which the usual mixing tube portion of the latter nozzle is permitted to have a relatively small diameter. The advantage of this is that the leading end of the weft yarn will enter into the weaving shed at a rather exactly defined location.

The performance of the weft inserting device as a main blowing nozzle and at least one auxiliary blowing nozzle in series therewith permits each of the blowing nozzles to be fed by air of a lower pressure than would be required when using one single blowing nozzle. Such a lower air pressure in itself means also a reduced chance of untwisting of the weft yarn.

In a practical embodiment of the invention the distance between the two blowing nozzles is 1 to 2 times the lineary cross sectional dimension of the mixing tube portion of the blowing nozzles.

Preferably the effective length of the auxiliary blowing nozzle is smaller than that of the main blowing nozzle.

Good weaving results may be obtained with a length ratio between 1:2 and 1:4.

The invention also relates to a pneumatic weft inserting device adapted to be used in a weaving machine, said device being characterized by at least two blowing nozzles arranged in series and located at one end of the weaving shed.

BRIEF DESCRIPTION OF THE DRAWINGS

The drawing shows a diagrammatic side elevational view of a weft inserting device embodying the invention, comprising two blowing nozzles of the injector type.

DESCRIPTION OF THE PREFERRED EMBODIMENT

The blowing nozzles 1 and 2, which are arranged in series, are each of a well-known type and comprise housings 1*a* and 2*a*, respectively, to which the transporting air is laterally supplied, mixing tubes 1*b* and 2*b*, respectively, connected to said housings. The mixing tubes 1*b* and 2*b* are effective in concentrating the transporting air supplied to the associated blowing nozzle into an air stream which envelopes the weft yarn and provides for the transfer of energy from the transporting air onto the weft yarn. Between the outlet end 1*c* of the mixing tube 1*b* and the yarn inlet end 2*d* of the blowing nozzle 2 there is an intermediary space, the axial length of which is about 1 to 2 times the lineary cross sectional dimension of the mixing tube 1*b*. The transporting air consumed by the blowing nozzle 1 laterally escapes through said space at the end of the associated mixing tube instead of being passed together with the weft yarn through the second blowing nozzle 2. Due to this, the efficiency of the weft inserting device is considerably improved. In the example shown, the main blowing nozzle 1 is mounted on the frame 4 of the weaving machine, while the auxiliary blowing nozzle 2 is carried by a lay 5. In this example, the ratio between the lengths L1 and L2 of the nozzles 1 and 2 is 1:3.

I claim:

1. A pneumatic weaving machine having air fed apparatus for inserting a weft into a weaving shed and which includes a main blowing nozzle and at least one auxiliary blowing nozzle, each having a weft inlet and a weft outlet, and being located adjacent to and outside of one end of the shed, the auxiliary blowing nozzle being arranged in series between the weft outlet of the main nozzle and the adjacent end of the shed, there being a free space between said outlet and the weft inlet end of the auxiliary mozzle through which the air stream from the main blowing nozzle laterally escapes.

2. A weaving machine according to claim 1 wherein each of the nozzles has a mixing tube and the distance between the two nozzles is one to two times the lineary cross sectional dimension of the mixing tubes.

3. A weaving machine according to claim 1 wherein the machine has a frame and a lay and the main blowing nozzle in mounted on the frame and the auxiliary blowing nozzle is mounted on the lay.

4. A weaving machine according to claim 1 wherein the length ratio between the main and auxiliary nozzles is between 1:2 and 1:4.

* * * * *